US012207719B2

(12) United States Patent
He et al.

(10) Patent No.: US 12,207,719 B2
(45) Date of Patent: Jan. 28, 2025

(54) HANDHELD HAIR DRYER

(71) Applicant: Xikui He, Shenzhen (CN)

(72) Inventors: Xikui He, Shenzhen (CN); Jie Wu, Shenzhen (CN)

(73) Assignee: Xikui He, Shenzhen (CN)

( * ) Notice: Subject to any disclaimer, the term of this patent is extended or adjusted under 35 U.S.C. 154(b) by 0 days.

(21) Appl. No.: 18/751,216

(22) Filed: Jun. 22, 2024

(65) Prior Publication Data

US 2024/0374011 A1 Nov. 14, 2024

Related U.S. Application Data

(63) Continuation of application No. PCT/CN2024/091706, filed on May 8, 2024.

(30) Foreign Application Priority Data

May 10, 2023 (CN) ..... 202310518552.0
Oct. 26, 2023 (CN) ..... 202322877699.7

(51) Int. Cl.
*A45D 20/12* (2006.01)

(52) U.S. Cl.
CPC ..... *A45D 20/12* (2013.01)

(58) Field of Classification Search
CPC ..... A45D 20/10; A45D 20/12; A45D 20/122
See application file for complete search history.

(56) References Cited

U.S. PATENT DOCUMENTS 4,287,673 A * 9/1981 Wolter ..... A45D 20/122 239/524
2003/0079366 A1* 5/2003 Chang ..... F04D 19/007 34/96
2007/0065124 A1* 3/2007 Cheng ..... A45D 20/12 392/384

FOREIGN PATENT DOCUMENTS

CN 111557539 A * 8/2020
CN 211608458 U * 10/2020

OTHER PUBLICATIONS

Translation, CN-111557539-A (Year: 2020).*
Translation, CN-211608458-U (Year: 2020).*

* cited by examiner

*Primary Examiner* — Jessica Yuen
(74) *Attorney, Agent, or Firm* — JEEN IP LAW, LLC

(57) ABSTRACT

A handheld hair dryer is provided, a handle part is provided with an air inlet, a blowing part is provided with a heating component, a windshield component, and a fan component. The windshield component includes a circular press cover, a circular protrusion configured to change a flow direction of air introduced by the fan component is provided around a center of the circular press cover. The heating component processes the air guided by the windshield component and discharges it into an air outlet. A non-negative pressure chamber is formed between the circular protrusion and a brushless motor to accelerate an air introduction rate. The circular press cover changes the flow direction of air introduced by the brushless motor, thereby dissipating heat generated by an operation of the brushless motor. The circular press cover is connected to a hollow installation column.

8 Claims, 8 Drawing Sheets

HANDHELD HAIR DRYER

CROSS-REFERENCE TO RELATED APPLICATIONS

This application is a continuation of International Application No. PCT/CN2024/091706, filed on May 8, 2024, which claims priority to Chinese Patent Application No. 202310518552.0, filed on May 10, 2023 and Chinese Patent Application No. 202322877699.7, filed on Oct. 26, 2023, both of which are hereby incorporated by reference in their entireties.

TECHNICAL FIELD

The present disclosure relates to the field of hair dryer technologies, and in particular, to a handheld hair dryer.

BACKGROUND

With a development of science and technology and an improvement of people's living standards, handheld hair dryers have become an essential personal care household appliance in people's daily lives. The handheld hair dryers include a handle part and a hair dryer. The existing large air volume handheld hair dryers use high-speed DC brushless motors, which are set at the handle part and the heating wire is set at the blowing part. The handle part and the blowing part are generally vertical, so air blown out by the high-speed DC brushless motor is not directly facing the heating wire, which leads to a decrease in air speed and an increase in noise. Therefore, some manufacturers set the high-speed DC brushless motor at a rear end of the blowing part, and the heating wire is set at the rear end of the blowing part. A front end of the hair dryer allows air blown out by the high-speed DC brushless motor to face the heating wire, so as to increase air speed or reduce the power of the motor, but the diameter of this type of hair dryer is designed to be relatively small. The main reason is that the diameter of the high-speed brushless motor is small, and the diameter of the blowing part is designed to accommodate the diameter of the high-speed brushless motor. Therefore, the volume of the heating wire in this type of hair dryer is also small, and heat generated is not enough. If the diameter of the blowing part of the hair dryer is increased to meet the volume of the heating wire, a problem will occur, which is that the noise is particularly loud. The basic reason is still because there is a negative pressure zone near the high-speed DC motor. The negative pressure zone, combined with air vibration and housing vibration, thus a relatively loud sound mag be produced.

SUMMARY

In order to solve the above-mentioned technical problems, the present disclosure provides a handheld hair dryer that can reduce noise of the hair dryer. The handheld hair dryer of the present disclosure not only significantly reduces noise of the hair dryer, but also improves heat dissipation effect of a power module. The technical solution of the present disclosure is as follows.

A handheld hair dryer, including:

a handle part and a blowing part connected to the handle part, the blowing part includes a housing, the housing is provided with a heating component, a fan component, and a windshield component located between the heating component and the fan component; the windshield component is configured to block partial air blown out by the fan component and change a direction of air flow; the air blown out by the fan component is guided by the windshield component and then flows out from an air outlet at a front end of the housing through the heating component.

In an embodiment of the present disclosure, the windshield component includes a circular press cover, and a circular protrusion configured to change a flow direction of air introduced by the fan component is provided around a center of the circular press cover.

In an embodiment of the present disclosure, an air inlet of the handheld hair dryer is located at a tail end of the handle part or/and a rear end of the blowing part.

In an embodiment of the present disclosure, the heating component includes a hollow installation column connected to the circular press cover, a heating chamber located around the hollow installation column, and heating wires provided around the hollow installation column and located in the heating chamber.

In an embodiment of the present disclosure, a plurality of limit columns corresponding to the hollow installation column are provided on the circular press cover.

In an embodiment of the present disclosure, the fan component includes a limit ring and a brushless motor located within the limit ring, and a first circuit board configured to control an operation of the brushless motor is provided on the limit ring.

The first circuit board is provided with a power module.

In an embodiment of the present disclosure, a diameter of the circular press cover is greater than a diameter of the hollow installation column.

In an embodiment of the present disclosure, the hollow installation column is provided with an inclined surface extending along the air outlet.

In an embodiment of the present disclosure, the handheld hair dryer further includes a second circuit board located within the handle part, and a button provided on the handle part and connected to the second circuit board, where the second circuit board is located between the button and the air inlet.

Compared with prior art, the present disclosure has the following beneficial effects:

by providing with the heating component, windshield component, and fan component in the blowing part, the windshield component is located between the heating component and the fan component. The air blown out of the fan component is partially blocked and the air flow direction is changed, so that the non-negative pressure chamber between the fan component and the windshield component has changed, thereby reducing air vibration in the blowing part and vibration of the housing, which can significantly reduce noise. On the other hand, the partial air blocked by the windshield component can flow back to the power module, thereby taking away heat on the power module and improving the service life of the power module.

The hollow installation column is provided with an inclined surface extending along the air outlet, and a horizontal plane of the inclined surface along a length direction of the handle part has an angle of 30°, so that hot air discharged from the air outlet first diffuses and then intersects, thereby expanding a blowing surface of the hair dryer.

BRIEF DESCRIPTION OF DRAWINGS

In order to provide a clearer explanation of the technical solution of the embodiments of the present disclosure, a brief introduction will be made to the accompanying drawings required in the embodiments. It should be understood that the following drawings only illustrate some embodiments of the present disclosure, and therefore should not be regarded as limiting the scope. For those skilled in in the art, other relevant drawings can be obtained based on these drawings without creative work.

Figure 1:
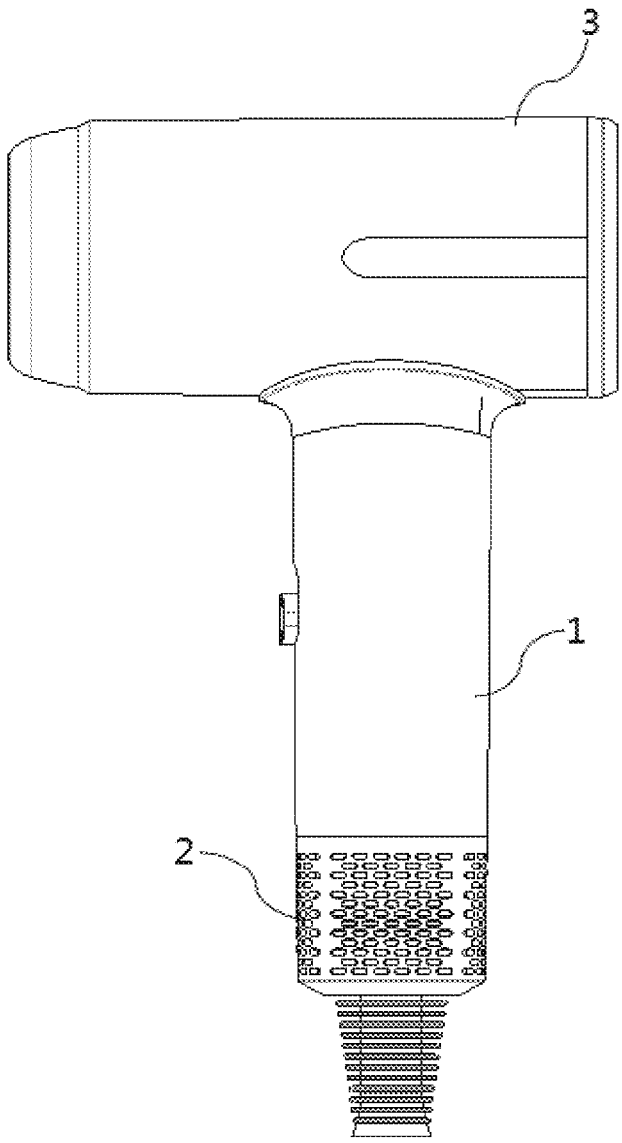
FIG. 1 is a side diagram of a handheld hair dryer in Embodiment 1 of the present disclosure.
Figure 2:
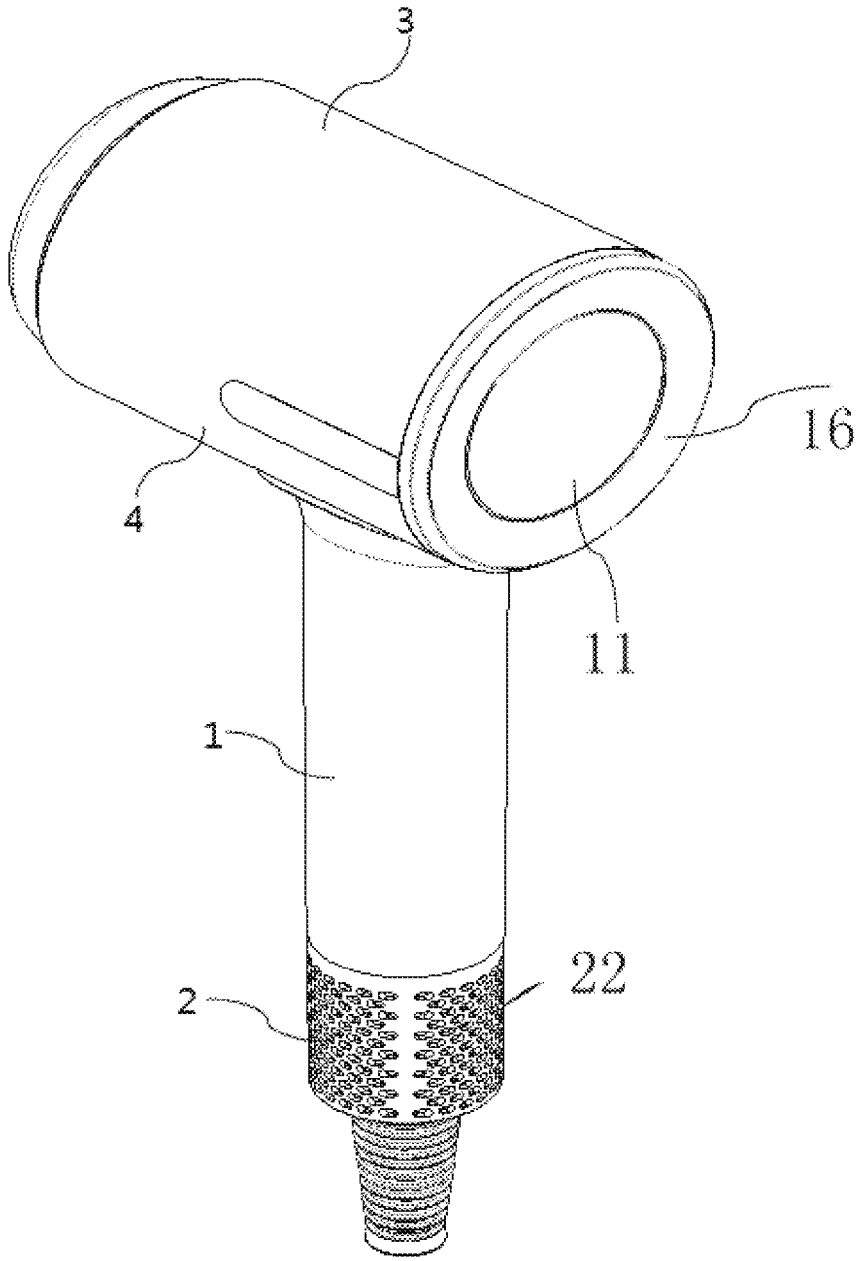
FIG. 2 shows a first three-dimensional view of the handheld hair dryer in Embodiment 1 of the present disclosure.
Figure 3:
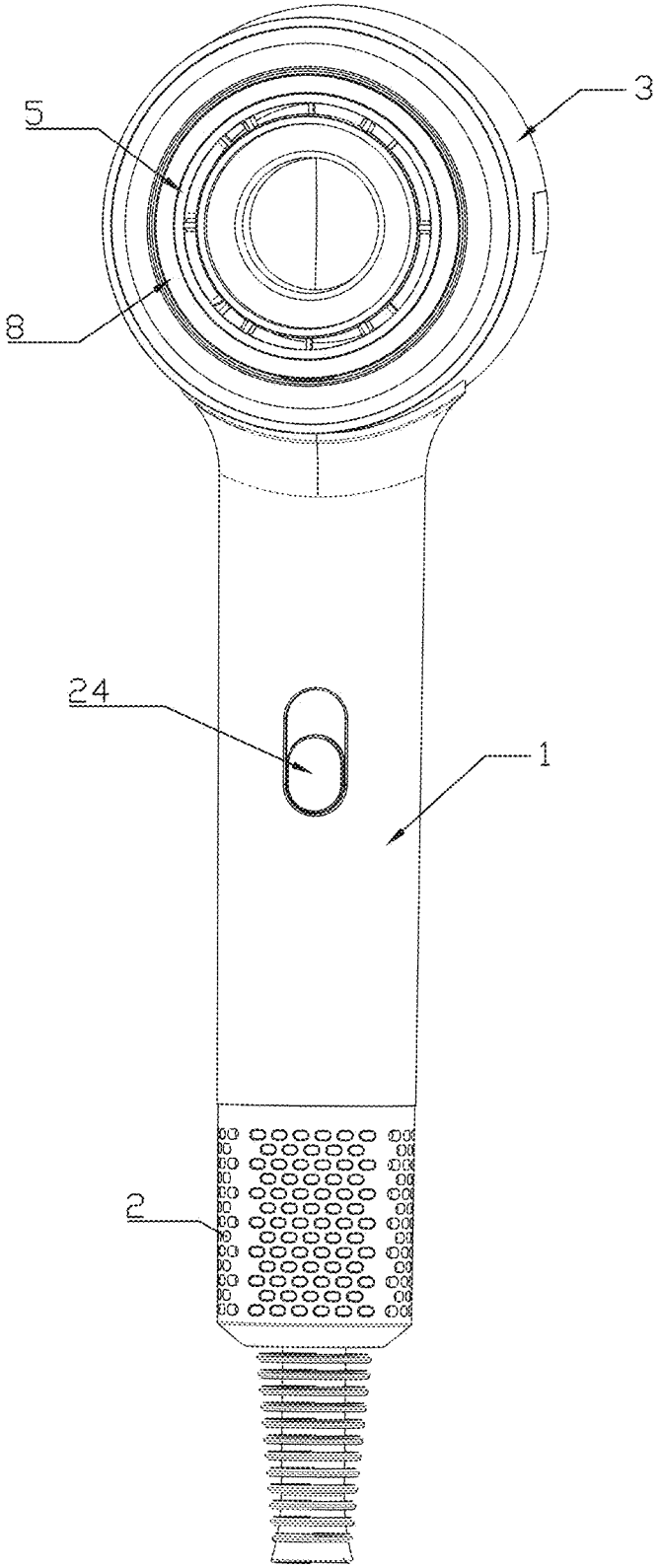
FIG. 3 shows a second three-dimensional view of the handheld hair dryer in Embodiment 1 of the present disclosure.
Figure 4:
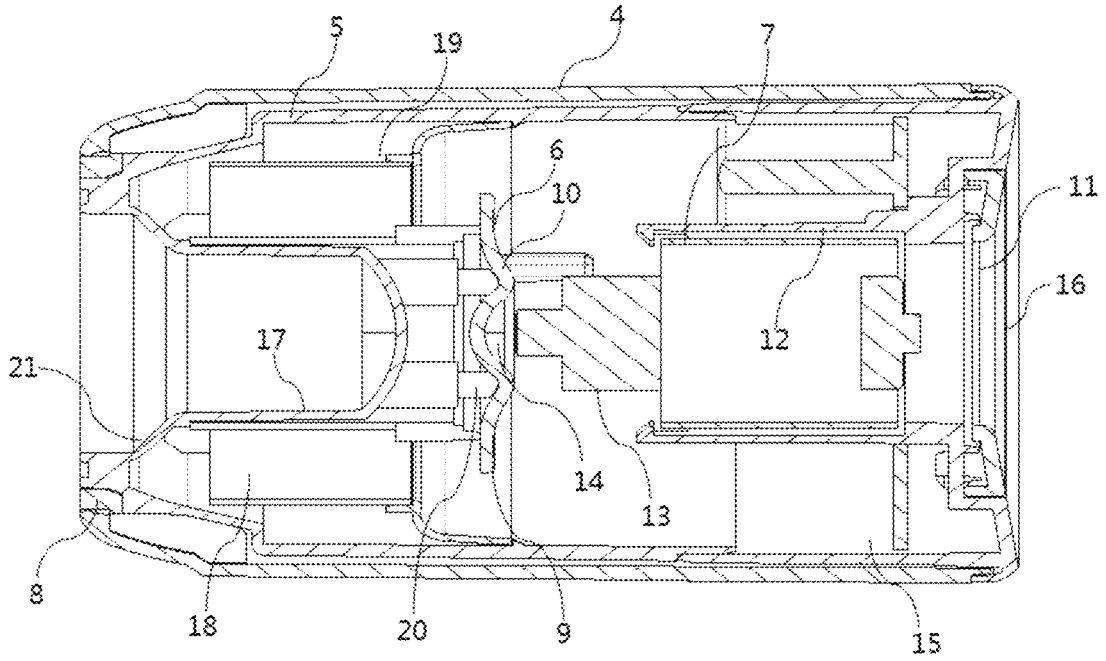
FIG. 4 is a schematic structural diagram of a blowing part in Embodiment 1 of the present disclosure.
Figure 5:
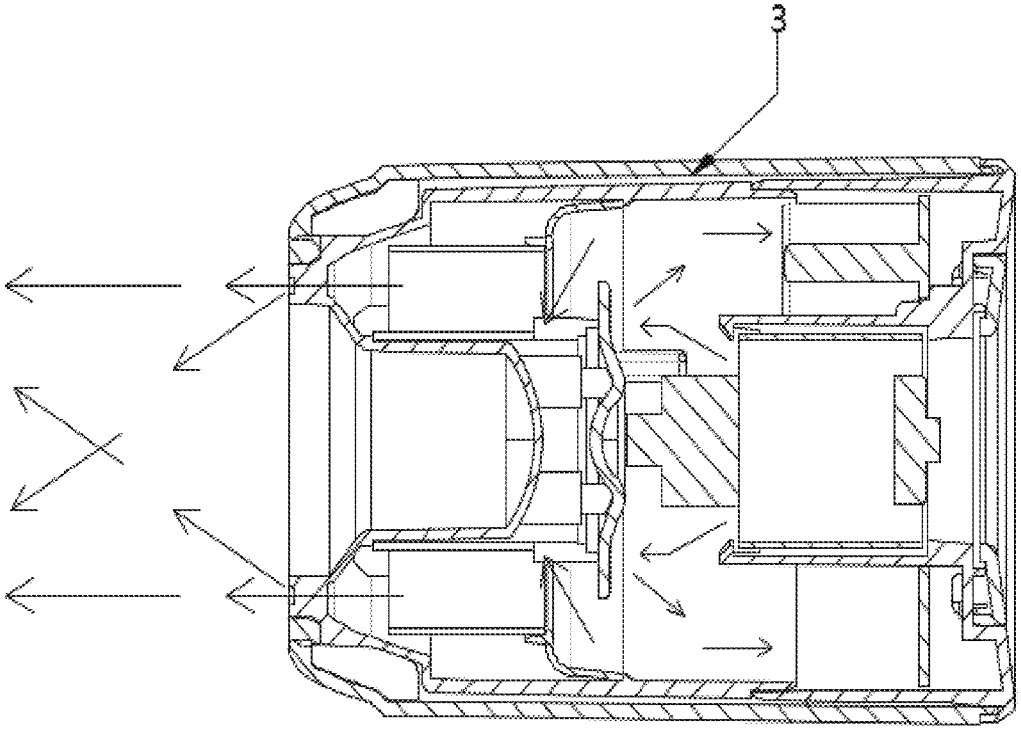
FIG. 5 is a schematic diagram of air flow direction in the blowing part of Embodiment 1 of the present disclosure.
Figure 6:
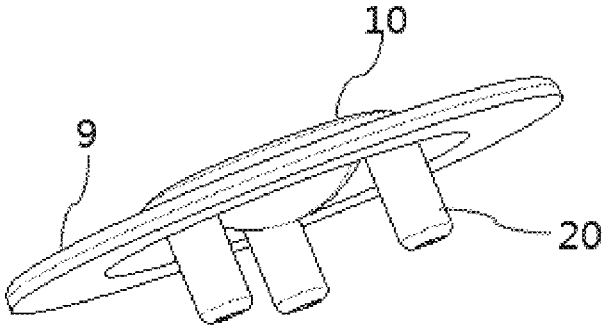
FIG. 6 is a schematic structural diagram of a circular press cover of the present disclosure.
Figure 7:
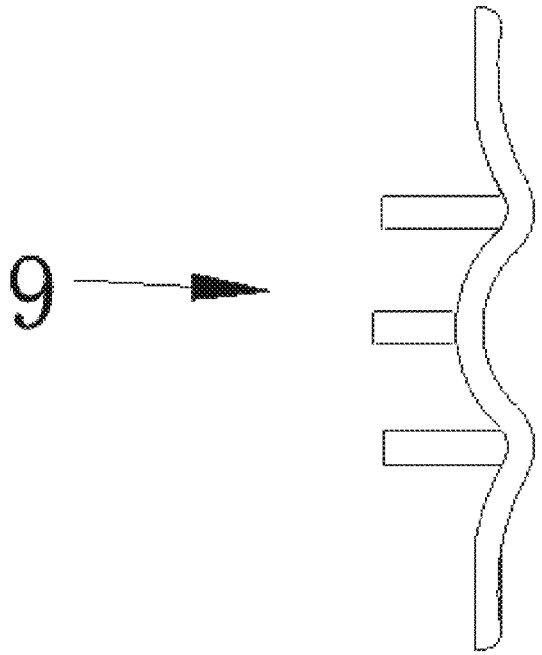
FIG. 7 is a side view of the circular press cover of the present disclosure.
Figure 8:
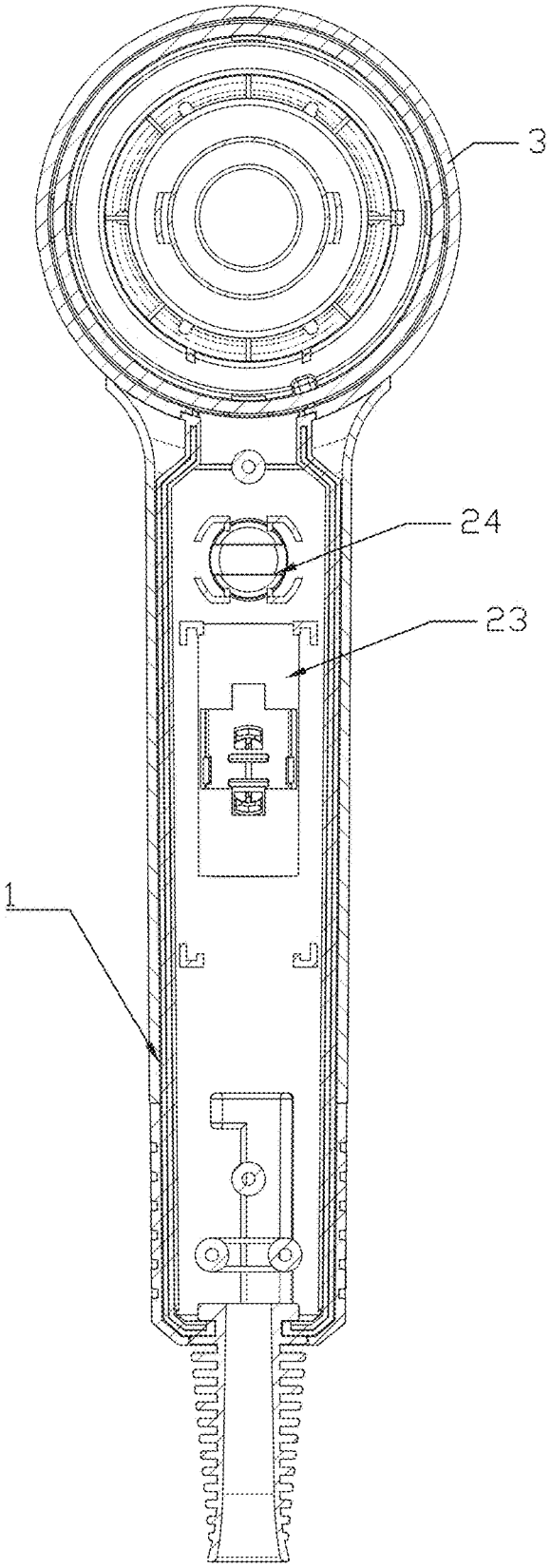
FIG. 8 is a schematic diagram of an internal structure of a handle part of the present disclosure.

Numeral reference: 1—handle part; 2—air inlet; 3—blowing part; 4—housing; 5—heating component; 6—windshield component; 7—fan component; 8—air outlet; 9—circular press cover; 10—circular protrusion; 11—baffle; 12—limit ring; 13—brushless motor; 14—non-negative pressure chamber; 15—first circuit board; 16—cover plate; 17—hollow installation column; 18—heating chamber; 19—heating wire; 20—limit column; 21—inclined surface; 22—filter screen; 23—second circuit board; 24—button.

DESCRIPTION OF EMBODIMENTS

The following provides a detailed description of embodiments of the present disclosure, examples of the embodiments are shown in the accompanying drawings, where identical or similar number reference throughout represent identical or similar components or elements with identical or similar functions. The embodiments described below with reference to the accompanying drawings are illustrative and intended only to explain the present disclosure, and cannot be understood as limitations to the present disclosure.

It should be noted that when a component is referred to as "fixed to" another component, it can be directly attached to another component or there can be an intermediate component. When a component is considered to be "connected" to another component, it can be directly connected to another component or there may be an intermediate component present simultaneously. On the contrary, when a component is referred to as "directly on" another component, there is no intermediate component. Terms "vertical", "horizontal", "left", "right", and similar expressions used in this specification are for illustrative purposes only.

In the present disclosure, unless otherwise specified and limited, terms "installation", "connection to", "connection with", "fixation" and other terms should be broadly understood, for example, they can be a fixed connection, a detachable connection, or an integrated connection; it can be a mechanical connection or an electrical connection; it can be directly connected or indirectly connected through an intermediate component, which can be an internal connection of two components or an interaction relationship between two components. For those skilled in the art, specific meanings of the above terms in the present disclosure can be understood based on a specific circumstance.

Embodiment 1

Referring to FIGS. 1 to 7, the present disclosure provides a handheld hair dryer, which includes:

a handle part 1 including an air inlet 2, where the air inlet 2 is provided at a tail end of the handle part 1; the handheld hair dryer further includes a blowing part 3 connected to the handle part 1, where the blowing part 3 includes a housing 4, a heating component 5 provided within the housing 4, a windshield component 6 connected to one end of the heating component 5, a fan component 7 provided within the housing 4 and corresponding to the windshield component 6, and an air outlet 30 located at the other end of the heating component 5. The windshield component 6 includes a circular press cover 9, and a circular protrusion 10 configured to change a flow direction of air introduced by the fan component 7 is provided around a center of the circular press cover 9. The heating component 5 heats air and causes it to be guided by the windshield component 6 and discharged from the air outlet 30.

The fan component 7 includes a baffle 11 provided on the housing 4, a limit ring 12 provided on the baffle 11, and a brushless motor 13 located within the limit ring 12. One end of the brushless motor 13 forms a non-negative pressure chamber 14 with the circular protrusion 10, and the other end of the brushless motor 13 is embedded on the baffle 11. A first circuit board 15 configured to control an operation of the brushless motor 13 and a cover plate 16 located between the baffle 11 and the housing 4 are also provided on the limit ring 12. The heating component 5 includes a hollow installation column 17 connected to the circular press cover 9, a heating chamber 18 located around the hollow installation column 17, and heating wires 19 provided around the hollow installation column 17 and located within the heating chamber 18. A plurality of limit columns 20 corresponding to the hollow installation column 17 are provided on the circular press cover 9, and a diameter of the circular press cover 9 is larger than that of the hollow installation column 17. The hollow installation column 17 is provided with an inclined surface 21 extending along the air outlet 30. A horizontal plane of the inclined surface 21 along a length direction of the handle part 1 has an angel of 30°. The handheld hair dryer further includes a filter screen 22 arranged on the housing 4 and located on the air inlet 2.

It should be noted that there are a plurality of air inlets 2, and the plurality of air inlets 2 are arranged on the handle part 1. An axis of each air inlet 2 can be parallel to or inclined relative to an axis of the brushless motor 13. A diameter of each air inlet 2 can be the same or different, and a distance between each two adjacent air inlets 2 can be the same or different. The handle part 1 and the blowing part 3 are arranged in a T-shape, the distance between the adjacent two air inlets 2 and a distance between the air inlet 2 and an air inlet end of the fan component 7 can effectively reduce noise generated in the housing 4 of the handheld hair dryer during operation. A motor body of the brushless motor 13 is wrapped by the limit ring 12. One end of the brushless motor 13 faces the circular press cover 9, and the other end of the brushless motor 13 is embedded on a surface of the baffle 11. The baffle 11 is fixedly connected to the housing 4, and a cover plate 16 is provided between the baffle 11 and the housing 4. The cover plate 16 can seal and install the brushless motor 13. The first circuit board 15 is provided on an outer side of the limit ring 12, the first circuit board 15 is connected to the brushless motor 13. A contact between an inner side of the limit ring 12 and the brushless motor 13 can be configured as a buckle connection to facilitate a fixation of the brushless motor 13. The brushless motor 13 replaces traditional motor fans and has characteristics of low noise and smooth operation. However, traditional methods use motor fans to introduce air into the housing 4. If it is necessary to accelerate an air flow speed in the housing 4, it will also increase speed or power of the motor fan, thus resulting in larger noise. One end of the brushless motor 13 is provided correspondingly to the circular press cover 9, and in an implementation, a center of the circular press cover 9 is located in a same horizontal plane as the axis of the brushless motor 13. The circular protrusion 10 forms the non-negative pressure chamber 14 with the brushless motor 13, allowing the brushless motor 13 to form a return whirlwind instead of a vortex wind under an obstruction of the circular press cover 9, thereby quickly filling a space in the housing 4 where the entire fan component 7 is located. In an implementation, a diameter of the circular protrusion 10 is 2-8 cm, and the specific situation can be set according to an actual situation. When the brushless motor 13 rotates, the airflow enters the non-negative pressure chamber 14, thereby accelerating the air flow in the housing 4.

The windshield component 6 is located between heating component 5 and the fan component 7, and a distance between the circular press cover 9 and the brushless motor 13 can be set according to an actual need. A plurality of limit columns 20 are provided on one side of the circular press cover 9 near the heating component 5, and the number of the limit columns 20 is preferred to be three. The limit columns 20, circular protrusion 10, and circular press cover 9 are formed as a whole. A length of the limit column 20 can be set according to the actual need. The limit columns 20 are inserted into the hollow installation columns 17 to achieve a stable installation of the circular press cover 9. One side of the hollow installation column 17 near the air outlet 8 is hollow, and the other side of the hollow installation column 17 is arc shaped. The heating wires 19 can be provided on a periphery of the hollow installation column 17, and the diameter of the circular press cover 9 is larger than that of the hollow installation column 17, and some heating wires 19 are covered by the circular press cover 9. The heating wires 19 form the heating chamber 18 with the housing 4, the heating chamber 18 is a circular ring shape. The diameter of the circular press cover 9 is also larger than a diameter of the main body of the brushless motor 13, which can effectively change the flow direction of air guided from the brushless motor 13, that is, the circular press cover 9 can change the flow direction of the guided air, and generate a certain amount of heat when the brushless motor 13 and the first circuit board 15 work. At this time, the air passing through the non-negative pressure chamber 14 and entering to the main body of the brushless motor 13 can dissipate heat for the brushless motor 13 and the first circuit board 15.

The hollow installation column 17 is provided with an inclined surface 21 extending along the air outlet 8. The horizontal plane of the inclined surface 21 along the length direction of the handle part 1 has an angle of 30°. After being filled with air in the housing 4 of the windshield component 6 and the fan component 7, it will flow to the heating chamber 18. The heating wires 19 in the heating chamber 18 will work to heat the air flowing into the heating chamber 18 and causes it to be discharged from the air outlet 8. After heated air is discharged from the air outlet 8, a flow direction of the hot air will generate a certain amount of wind intersection at a distance of 15-20 cm from the air outlet 8, thereby increasing a blowing surface. A length of the hollow installation column 17 along the horizontal plane where the brushless motor 13 is located is preferably 3-10 cm. The heating wires 19 extends from a direction parallel to the circular press cover 9 to the air outlet 8, which can fully heat the air treated by the windshield component 6 so as to improve a thermal efficiency of the heating wires 19 in heating the air.

The circular press cover 9 is made of plastic material or resin, which is integrally formed. Compared with traditional noise reduction and silencing devices, its preparation process is simple, thereby reducing the cost of the handheld hair dryer. The heating component 5, windshield component 6, and fan component 7 in the blowing part 3 are connected or inserted. When the handheld hair dryer falls from a height of 1.5 m, it will not affect looseness or damage of the components inside the housing 4, thereby improving the service life and working stability of the handheld hair dryer. In order to clean the air discharged from the air outlet 8, a circular filter screen 22 is provided on the housing 4 of the air inlet 2, and aperture of the filter screen 22 can be set according to an actual situation. The installation method of the heating component 5, windshield component 6, and fan component 7 does not affect aesthetics of traditional direct blowing hair dryer. Introducing air from the air inlet 2 of the handle part 1 can reduce working noise of the handheld hair dryer to a certain extent. The operation and structure are simple, and it is convenient to carry.

The handheld hair dryer further includes a handheld hair dryer and a second circuit board 23 located within the handle part 1, as well as a button 24 provided on the handle part 1 and connected to the second circuit board 23. The second circuit board 23 is located between the button 24 and the air inlet 2.

In this embodiment, the second circuit board 23 is provided with a control unit, the first circuit board is provided with a power module, and the button 24 can be a start switch, a heating switch, or an air volume switch, which can be set according to an actual situation. The second circuit board 23 is located between the air inlet 2 and the button 24, rendering it convenient to hold and operate the button 24. The second circuit board 23 can form a plurality of air ducts for the air guided by the air inlet 2, thereby increasing speed of air introduction into the blowing part 3. The button 24 can be press or touch type, and the air inlet 2 is located at a position of power cord that connects the handle part 1.

In a specific application, the handle part 1 is hold and the button 24 is operated, the brushless motor 13 and heating wire 19 are caused to work. The brushless motor 13 introduces air through the air inlet 2 (as shown by arrow direction in the drawing), and the air flows into the non-negative pressure chamber 14. After the non-negative pressure chamber 14 is filled with air, and it is blocked by the circular press cover 9, thereby allowing the air inside the non-negative pressure chamber 14 to flow in a direction of the baffle 11. At this time, the air that has changed flow direction can dissipate heat for the brushless motor 13 and the first circuit board 15. The air then enters the heating chamber 18 through passing a periphery of the circular cover plate 9. The heating wires 19 heat air to increase a flow rate of hot air and the hot air is discharged from the air outlet 8. As the horizontal plane of the inclined surface 21 along the length direction of the handle part 1 has an angle of 30°, so that the hot air discharged from the air outlet 8 first diffuses and then intersects at a distance of 15-20 cm from the air outlet 8, thereby improving the reliability of the hair dryer.

It should be understood that the present disclosure provides a handheld hair dryer, by providing with a plurality of air inlets 2 on the handle part 1, the blowing part 3 is provided with the heating component 5, windshield component 6, and fan component 7. The windshield component 6 is located between the heating component 5 and the fan component 7. The windshield component 6 includes the circular press cover 9, and the circular protrusion 10 configured to change the flow direction of air guided by the fan component 7 is provided around the center of the circular press cover 9. The heating component 5 processes the air guided by the windshield component 7 and then discharges it to the air outlet 8. The air is introduced into the housing 4 by the brushless motor 13, and the non-negative pressure chamber 14 is formed between the circular protrusion 10 and the brushless motor 13 so as to accelerate the air introduction rate, and the circular press cover 9 can change the flow direction of the air guided by the brushless motor 13, thereby dissipating heat generated by the operation of the brushless motor 13. The fan component 7 and the housing 4 are sealed and fixed, and the circular press cover 9 is detachably connected to the hollow installation column 17. The heating chamber 18 is located around the hollow installation column 17 and the heating wires 19 are provided in the heating chamber 18, which can effectively heat the air treated by the windshield component 6 and improve the thermal efficiency of the device. A cooperation between the brushless motor 13 and the circular press cover 9 can effectively change the air flow direction and reduce noise. The hollow installation column 17 is provided with the inclined surface 21 extending along the air outlet 8, the horizontal plane of inclined surface 21 along the length direction of the handle part 1 has an angle of 30°. This allows the hot air discharged from the air outlet 8 to diffuse first and then intersect, thereby expanding the blowing surface of the hair dryer. The structure is simple and easy to operate, and to a certain extent, thereby improving the working reliability of the handheld hair dryer.

Embodiment 2

Figure 9:
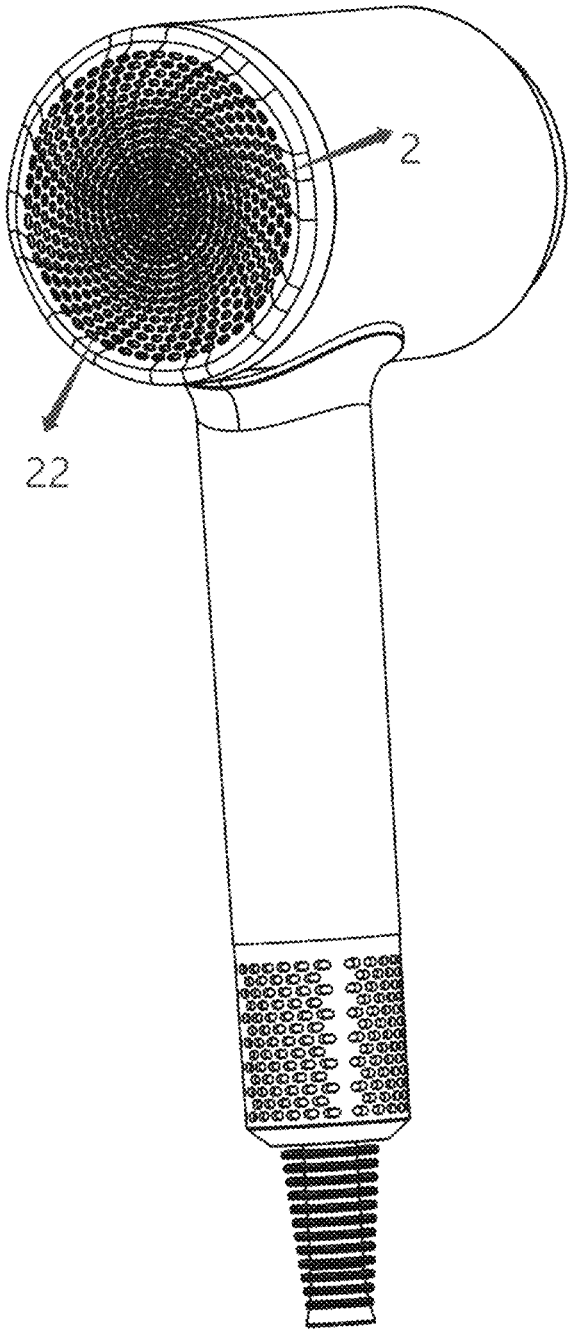
FIG. 9 is a three-dimensional view of the handheld hair dryer in Embodiment 2 of the present disclosure.
Figure 10:
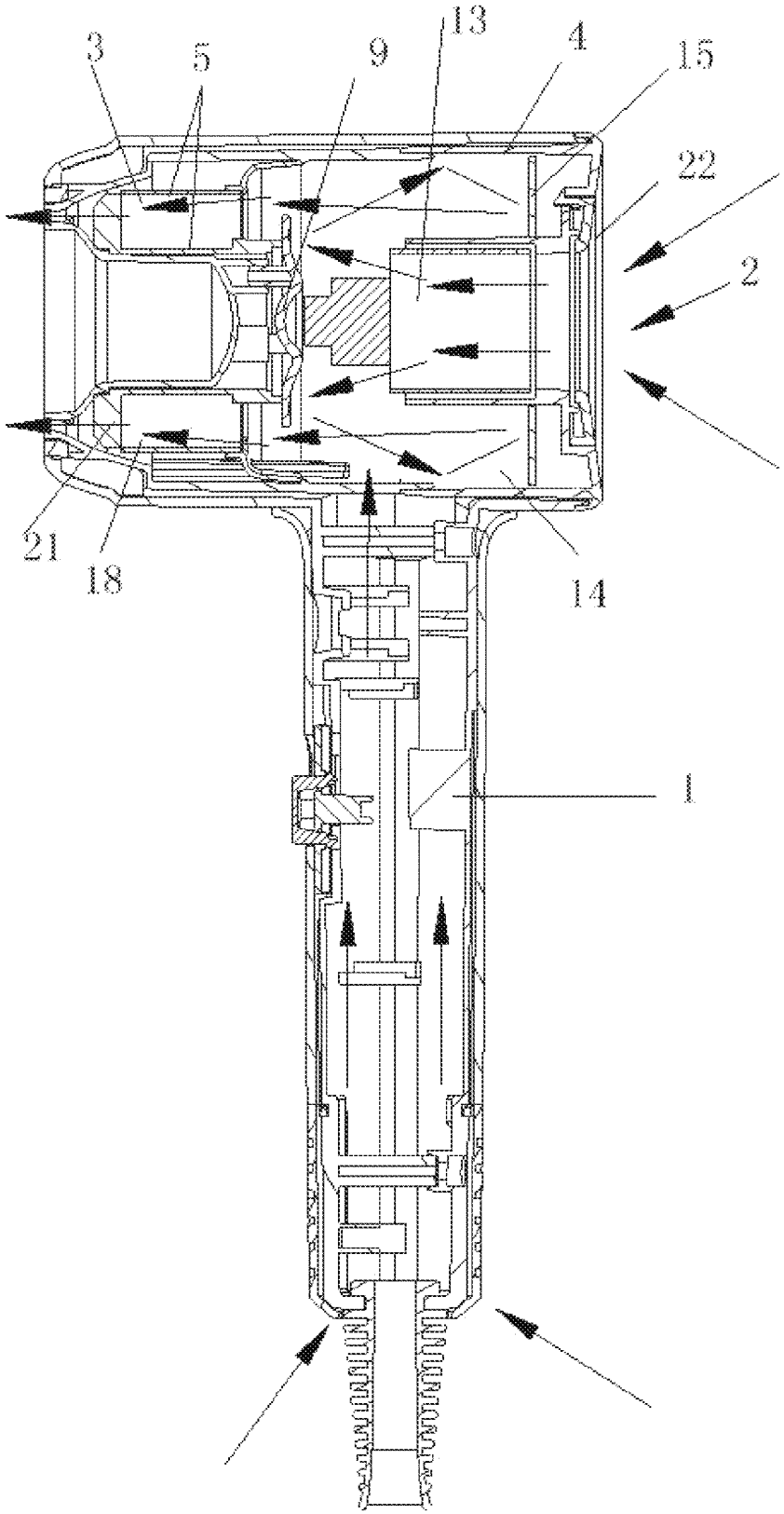
FIG. 10 is a schematic diagram of the air flow direction of the handheld hair dryer in Embodiment 2 of the present disclosure.

As shown in FIGS. 9-10, unlike in Embodiment 1, the air inlet of the handheld hair dryer is provided at a tail end of the handle part, the air inlet 2 of the handheld hair dryer is provided at the rear end of the blowing part. Unlike in E Embodiment 1, the baffle and cover plate are provided at the rear end of the blowing part, a hole is provided at the rear end of the blowing part, and the filter screen 22 is provided at the rear end of the blowing part. The air driven by the brushless motor 13 through high-speed rotation can directly enter from the rear end of the blowing part and then flow to the windshield component 6. The windshield component 6 block partial air blow out from the brushless motor 13 back to the first circuit board 15 and fill the entire non-negative pressure chamber 14 with air. Under an air pressure driven by a continuous rotation of the high-speed brushless motor 13, the air in the non-negative pressure chamber 14 continues to pass through the heating component 5 and flow out from the air outlet 8. In this embodiment, air mainly enters through the rear end of the blowing part, with some air entering from the tail end of the handle part, and the air entering from the tail end of the handle part can promote the heat dissipation of the second circuit board 23.

Of course, those skilled in the art can easily combine Embodiment 1 and Embodiment 2 to seal the tail end of the handle part, allowing air to enter completely from the rear end of the blowing part. This design is also within the protection scope of the present disclosure.

In all examples shown and described here, any specific value should be interpreted as merely illustrative and not as a limitation, therefore, other examples of exemplary embodiments may have different values.

It should be noted that similar number reference represents similar terms in the following drawings. Therefore, once a term is defined in one drawing, it does not need to be further defined or explained in subsequent drawings.

The above embodiments only express some implementation modes of the present disclosure, and the description is specific and detailed, but cannot be understood as a limitation on the scope of the present disclosure. It should be pointed out that for those skilled in the art, several modifications and improvements can be made without departing from the concept of the present disclosure, all of which fall within the protection scope of the present disclosure.

What is claimed is:

1. A handheld hair dryer, comprising:

a handle part and a blowing part connected to the handle part, the blowing part comprises a housing, the housing is provided with a heating component, a fan component, and a windshield component located between the heating component and the fan component; the windshield component is configured to block partial air blown out by the fan component and change a direction of air flow; air blown out by the fan component is guided by the windshield component and then flows out from an air outlet at a front end of the housing through the heating component;

wherein the windshield component comprises a circular press cover, and a circular protrusion configured to change a flow direction of air introduced by the fan component is provided around a center of the circular press cover;

wherein the heating component comprises a hollow installation column connected to the circular press cover, and the fan component comprises a brushless motor;

a diameter of the circular press cover is greater than a diameter of the hollow installation column, and also greater than a diameter of a main body of the brushless motor;

one end of the brushless motor forms a non-negative pressure chamber with the circular protrusion.

2. The handheld hair dryer according to claim 1, wherein an air inlet of the handheld hair dryer is located at a tail end of the handle part or/and a rear end of the blowing part.

3. The handheld hair dryer according to claim 1, wherein the heating component further comprises a heating chamber located around the hollow installation column and heating wires provided around the hollow installation column and located in the heating chamber.

4. The handheld hair dryer according to claim 3, wherein the hollow installation column is provided with an inclined surface extending along the air outlet.

5. The handheld hair dryer according to claim 4, wherein a horizontal plane of the inclined surface along a length direction of the handle part has an angel of 30°.

6. The handheld hair dryer according to claim 1, wherein a plurality of limit columns corresponding to the hollow installation column are provided on the circular press cover.

7. The handheld hair dryer according to claim 1, wherein the fan component further comprises a limit ring, and a first circuit board configured to control an operation of the brushless motor is provided on the limit ring.

8. The handheld hair dryer according to claim 1, wherein the handheld hair dryer further comprises a second circuit board located within the handle part, and a button provided on the handle part and connected to the second circuit board, wherein the second circuit board is located between the button and an air inlet.

* * * * *